US007980535B2

(12) United States Patent
Dovich et al.

(10) Patent No.: US 7,980,535 B2
(45) Date of Patent: Jul. 19, 2011

(54) DEMAND ACTIVATED STEAM DISPERSION SYSTEM

(75) Inventors: Michael E. Dovich, Chaska, MN (US); Robert Russell Nelson, Apple Valley, MN (US); James M. Lundgreen, Lakeville, MN (US)

(73) Assignee: Dristeem Corporation, Eden Prairie, MN (US)

( * ) Notice: Subject to any disclaimer, the term of this patent is extended or adjusted under 35 U.S.C. 154(b) by 1051 days.

(21) Appl. No.: 11/804,991

(22) Filed: May 21, 2007

(65) Prior Publication Data

US 2008/0290533 A1 Nov. 27, 2008

(51) Int. Cl.
*B01F 3/04* (2006.01)

(52) U.S. Cl. .. 261/128; 261/118; 261/131; 261/DIG. 15

(58) Field of Classification Search ..... 261/39.1, 261/53, 115, 118, 128, 130, 131, DIG. 15
See application file for complete search history.

(56) References Cited

U.S. PATENT DOCUMENTS

| | | | | |
|---|---|---|---|---|
| 903,150 | A | | 11/1908 | Braemer |
| 1,101,902 | A | | 6/1914 | Braemer |
| 3,096,817 | A | | 7/1963 | McKenna |
| 3,215,416 | A | | 11/1965 | Liben |
| 3,268,435 | A | * | 8/1966 | Sellin ..... 208/132 |
| 3,386,659 | A | | 6/1968 | Rea |
| 3,443,559 | A | | 5/1969 | Pollick |
| 3,486,697 | A | | 12/1969 | Fraser |
| 3,635,210 | A | | 1/1972 | Morrow |
| 3,857,514 | A | | 12/1974 | Clifton |
| 3,870,484 | A | * | 3/1975 | Berg ..... 96/265 |
| 3,923,483 | A | | 12/1975 | Hilmer et al. |
| 3,955,909 | A | * | 5/1976 | Craig et al. ..... 431/10 |
| 4,384,873 | A | | 5/1983 | Herr |
| 4,913,856 | A | | 4/1990 | Morton |
| 4,967,728 | A | | 11/1990 | Dueck |
| 5,126,080 | A | | 6/1992 | Morton et al. |
| 5,277,849 | A | | 1/1994 | Morton et al. |
| 5,372,753 | A | | 12/1994 | Morton |
| 5,376,312 | A | | 12/1994 | Morton et al. |
| 5,516,466 | A | | 5/1996 | Schlesch et al. |
| 5,525,268 | A | | 6/1996 | Reens |
| 5,543,090 | A | | 8/1996 | Morton et al. |

(Continued)

FOREIGN PATENT DOCUMENTS

WO WO 00/57112 9/2000

(Continued)

OTHER PUBLICATIONS

NORTEC Inc., Web Page, SAM-e—Short Absorption Manifold—Submittal Drawings, Printed May 21, 2007, pp. 1-26.

(Continued)

*Primary Examiner* — Scott Bushey
(74) *Attorney, Agent, or Firm* — Merchant & Gould P.C.

(57) ABSTRACT

A steam dispersion system is disclosed. The steam dispersion system includes a header, a divider dividing the header into at least two interior chambers that are generally not in fluid communication with each other, and at least two steam dispersion tubes, each steam dispersion tube communicating with only one interior chamber. Each interior chamber includes a separate steam flow valve for independently controlling the amount of steam flow to each chamber based on the difference between a measured humidity value and a predetermined desired humidity value.

17 Claims, 13 Drawing Sheets

U.S. PATENT DOCUMENTS

| | | | |
|---|---|---|---|
| 6,065,740 | A | 5/2000 | Morton |
| 6,092,794 | A | 7/2000 | Reens |
| 6,227,526 | B1 | 5/2001 | Morton |
| 6,398,196 | B1 | 6/2002 | Light et al. |
| 6,485,537 | B2 | 11/2002 | Brilmaker |
| 6,488,219 | B1 | 12/2002 | Herr |
| 6,631,856 | B2 | 10/2003 | Herr |
| 6,824,127 | B2 | 11/2004 | Park et al. |
| 2001/0045674 | A1 | 11/2001 | Herr |
| 2002/0089075 | A1 | 7/2002 | Light et al. |
| 2002/0163092 | A1 | 11/2002 | Park et al. |
| 2004/0026539 | A1 | 2/2004 | Herr |
| 2005/0212152 | A1 | 9/2005 | Reens |

FOREIGN PATENT DOCUMENTS

| | | | |
|---|---|---|---|
| WO | WO 2007/099299 | A1 | 9/2007 |

OTHER PUBLICATIONS

International Search Report and Written Opinion mailed Jul. 31, 2008.

* cited by examiner

DEMAND ACTIVATED STEAM DISPERSION SYSTEM

TECHNICAL FIELD

The principles disclosed herein relate generally to the field of steam dispersion humidification. More particularly, the disclosure relates to a steam dispersion system that controls the amount of steam dispersed in response to a humidity load condition.

BACKGROUND

In the humidification process, steam is normally discharged from a steam source as a dry gas. As steam mixes with cooler duct air, some condensation takes place in the form of water particles. Within a certain distance, the water particles are absorbed by the air stream within the duct. The distance wherein water particles are completely absorbed by the air stream is called absorption distance. Another term that may be used is a non-wetting distance. This is the distance wherein water particles or droplets no longer form on duct equipment (except high efficiency air filters, e.g.). Past the non-wetting distance, visible wisps of steam (water droplets) may still be visible, for example, saturating high efficiency air filters. However, other structures will not become wet past this distance. Absorption distance is typically longer than the non-wetting distance and occurs when visible wisps have all disappeared and the water vapor passes through high efficiency filters without wetting them. Before the water particles are absorbed into the air within the non-wetting distance and ultimately the absorption distance, the water particles collecting on duct equipment may adversely affect the life of such equipment. Thus, a short non-wetting or absorption distance is desirable.

Steam dispersion systems are configured and sized to accommodate for a design condition, also known as the highest load. The appropriate number of dispersion tubes, number of nozzles, and/or orifice size of the nozzles are chosen to achieve the needed non-wetting or absorption distance and the load at the design condition. Some of the current steam dispersion humidification designs use closely spaced tubes with hundreds, even thousands, of nozzles to achieve a short non-wetting or absorption distance at the highest load. Such designs may undesirably heat the duct air and create significant amounts of unwanted condensate. However, if the number of tubes and/or nozzles is decreased, although the heat gain and condensate is reduced significantly, the non-wetting or the absorption distances are increased dramatically at high humidification loads and steam output may be insufficient when the humidification load is at or near 100%.

It is known that when the humidification loads are at or near 100%, i.e., when the humidification demand is at or near 100%, the non-wetting or the absorption distances are increased greatly. The non-wetting or absorption distances become reduced as the humidification load decreases. Although humidifiers are designed to simultaneously accommodate the highest load and an acceptable short non-wetting or absorption distance, humidifiers spend much of their time at loads significantly below 100%. Therefore, the maximum steam dispersion capacity of a system is not normally required to maintain the desired humidity and the non-wetting or absorption distance. Thus, it would be desirable to control or shut off portions of a dispersion system to reduce the air heat gain and condensate when operating at significantly less than 100% load.

SUMMARY

The principles disclosed herein relate to a steam dispersion system that controls the number of active steam dispersion tubes in response to a humidity load condition to ensure acceptable non-wetting or absorption distances and reduced heat gain and condensate when the maximum dispersion capacity of the system is not needed.

In one particular aspect, the disclosure is directed to a steam dispersion system that includes a header which is divided into separate isolated chambers by a divider. The steam dispersion tubes of the system are also divided so as to communicate with only those chambers that they are associated with. The steam dispersion system includes a control system for automatically activating or deactivating, thus supplying or cutting off steam to, a given chamber in response to a humidification demand, so as to only activate dispersion tubes when needed.

A variety of additional inventive aspects will be set forth in the description that follows. The inventive aspects can relate to individual features and combinations of features. It is to be understood that both the foregoing general description and the following detailed description are exemplary and explanatory only and are not restrictive of the broad inventive concepts upon which the embodiments disclosed herein are based.

DETAILED DESCRIPTION

Figure 1:
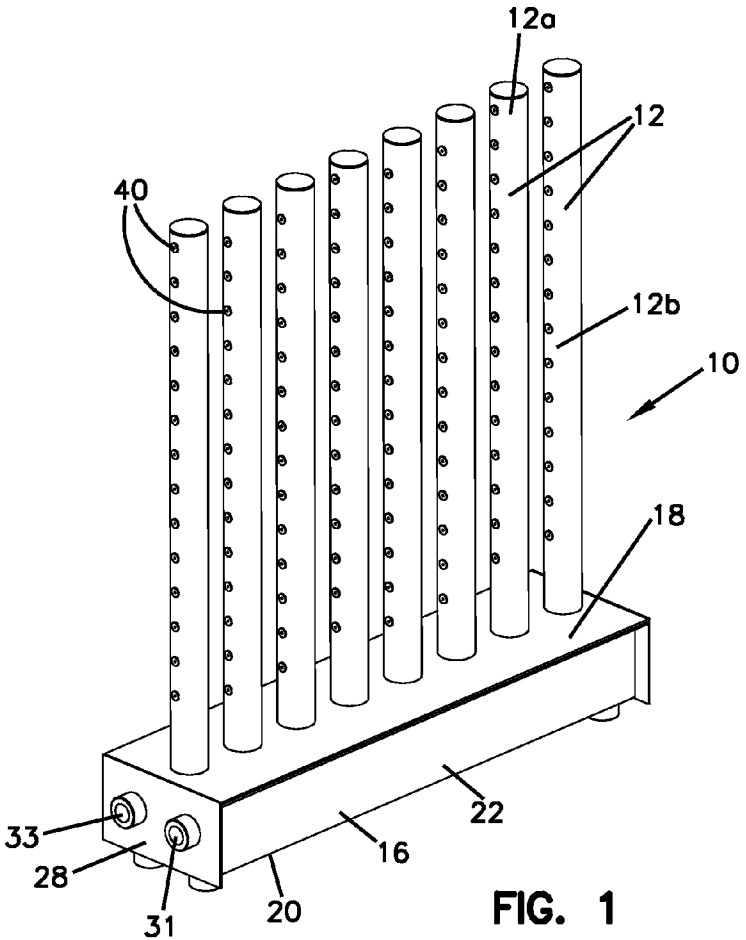
FIG. 1 is a perspective view of a steam dispersion system having features that are examples of inventive aspects in accordance with the principles of the present disclosure.
Figure 4:
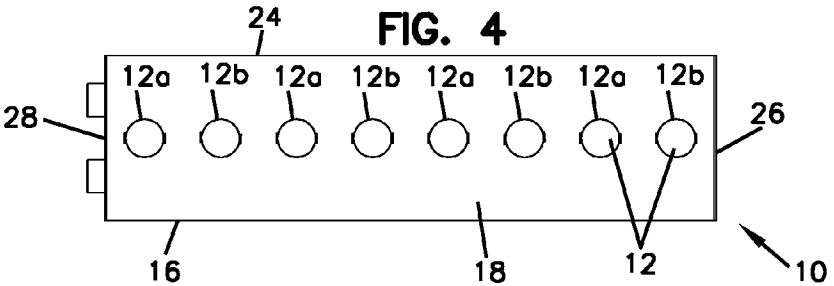
FIG. 4 is a top view of the steam dispersion system of FIG. 1.
Figure 3:
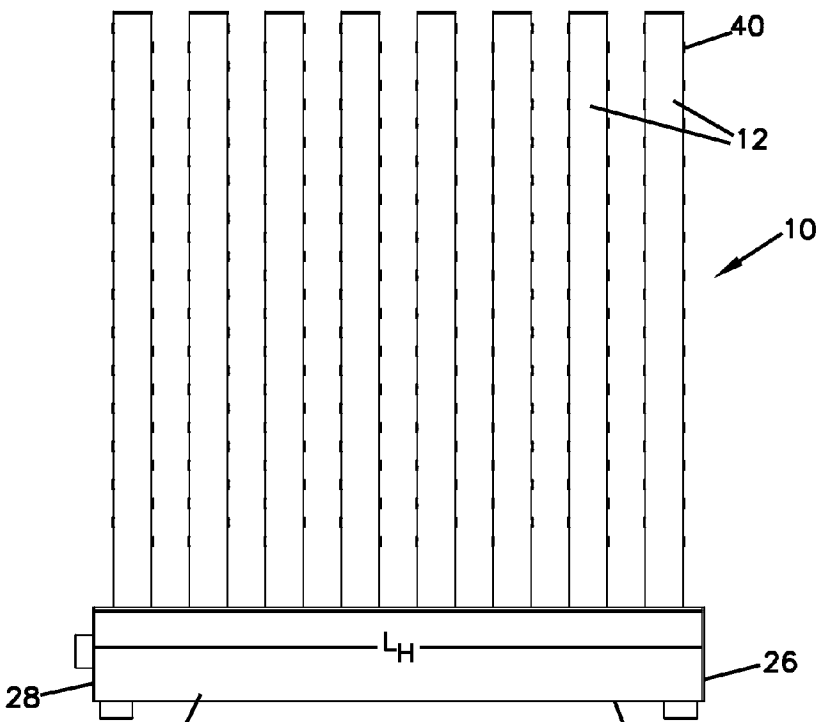
FIG. 3 a front view of the steam dispersion system of FIG. 1.
Figure 2:
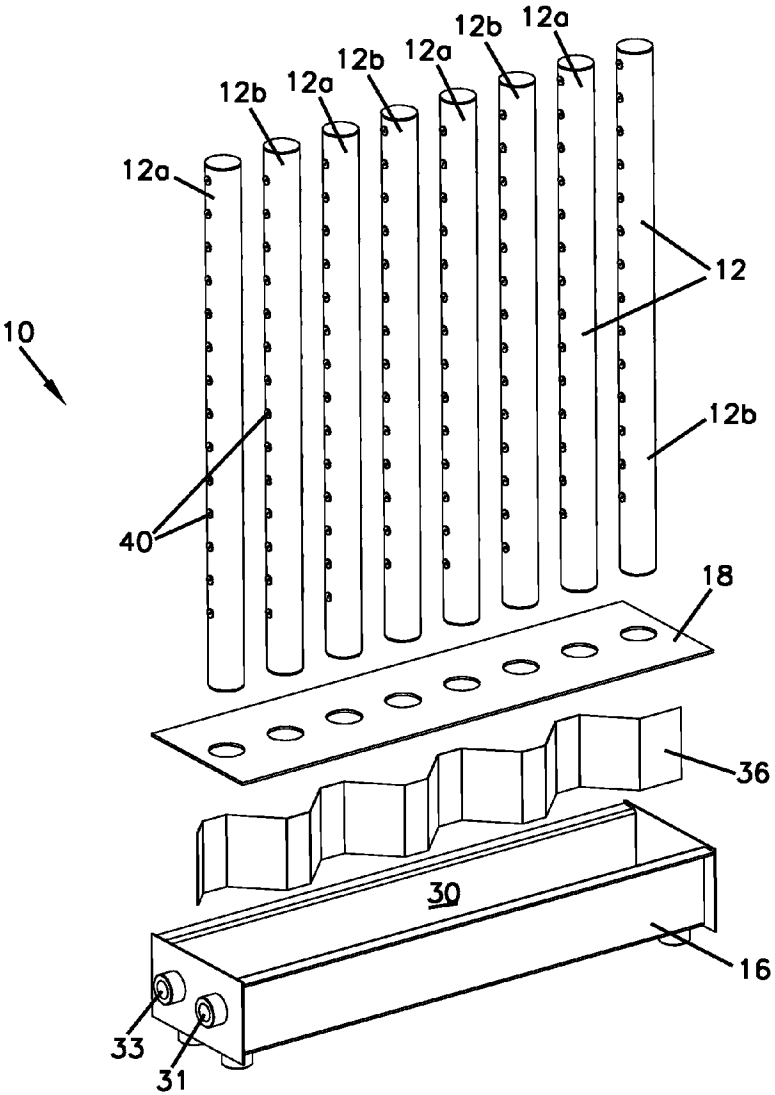
FIG. 2 is an exploded perspective view of the steam dispersion system of FIG. 1.

The steam dispersion system having features that are examples of inventive aspects in accordance with the principles of the present disclosure may include at least two independent steam dispersion tubes within a single system wherein each tube may be individually turned on or off to meet a humidity demand. In certain embodiments, wherein the steam dispersion system includes a plurality of steam dispersion tubes, the system selectively allows less than all of its steam dispersion tubes to remain active during light or moderate humidification loads, thus, reducing unwanted heat gain and condensate during these conditions, without sacrificing short non-wetting or absorption distances. The steam dispersion system may include a single control system that regulates all of the tubes, wherein the control system may automatically prevent steam flow into a number of its steam dispersion tubes, inactivating those tubes, when those dispersion tubes are not needed to meet the humidity demands.

A steam dispersion system 10 having features that are examples of inventive aspects in accordance with the principles of the present disclosure is illustrated in FIGS. 1-4. The steam dispersion system 10 includes a header 16 with a top wall 18, a bottom wall 20, a front wall 22, a rear wall 24, a right sidewall 26, and a left sidewall 28, cooperatively defining an interior 30. In the depicted embodiment, the header 16 includes generally a rectangular cross-sectional shape, wherein the top wall 18, the bottom wall 20, the front wall 22, the rear wall 24, the right sidewall 26, and the left sidewall 28 are generally planar, defining substantially right angles therein between.

Figure 6:
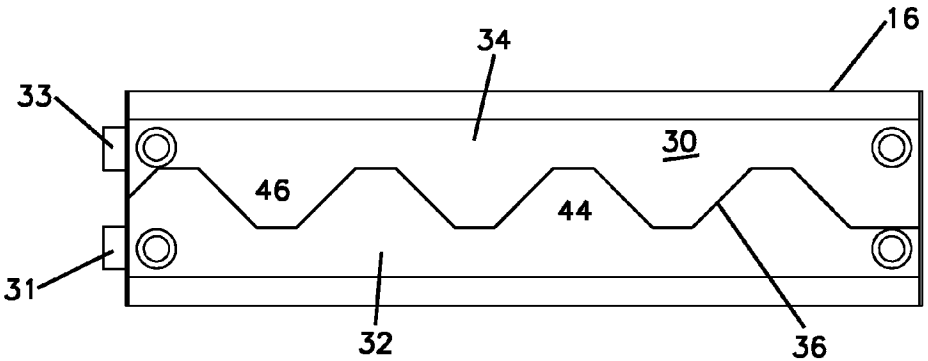
FIG. 6 is a top view of the header and the divider of FIG. 5.
Figure 5:
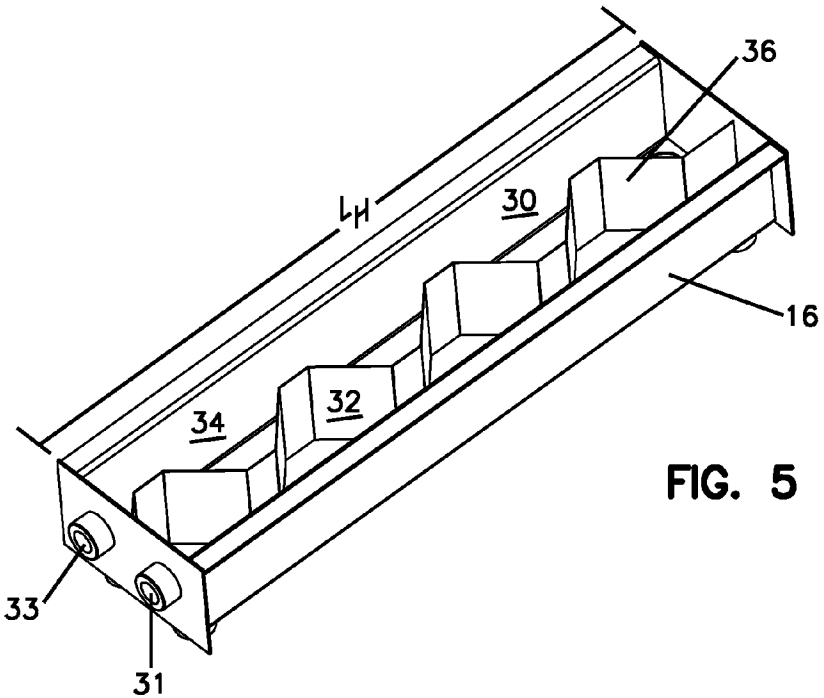
FIG. 5 is a perspective view showing a header and a divider within the header of the steam dispersion system of FIG. 1.

Referring now to FIGS. 5 and 6, the interior 30 of the header 16 is divided into a first chamber 32 and a second chamber 34 via a divider 36. The first chamber 32 and the second chamber 34 are separated from each other such that there is substantially no fluid communication between the chambers 32, 34 within the header 16. The header 16 includes a separate steam inlet 31, 33 for each of the first and second chambers 32, 34, respectively.

Referring back to FIGS. 1-4, the steam dispersion system 10 includes a plurality of steam dispersion tubes 12 extending from the top wall 18 of the header 16. The steam dispersion tubes 12 may be mounted to the header 16 by a number of different techniques including welding, fastening, etc. The header 16 receives steam from a steam source, such as a boiler (not shown), and the steam is dispersed into air through steam dispersion nozzles 40 of the steam tubes 12.

The divider 36 within the header 16 is shaped such that half the tubes 12*a* communicate only with the first chamber 32 and the other half of the tubes 12*b* communicate with the second chamber 34, as will be described in further detail below. It should be noted that in other embodiments, the divider may be shaped to divide the header into more than two chambers. It is also contemplated that the total number of tubes do not have to be equally divided with respect to the divided chambers and some chambers may communicate with a larger number of tubes than other chambers.

Figure 7:
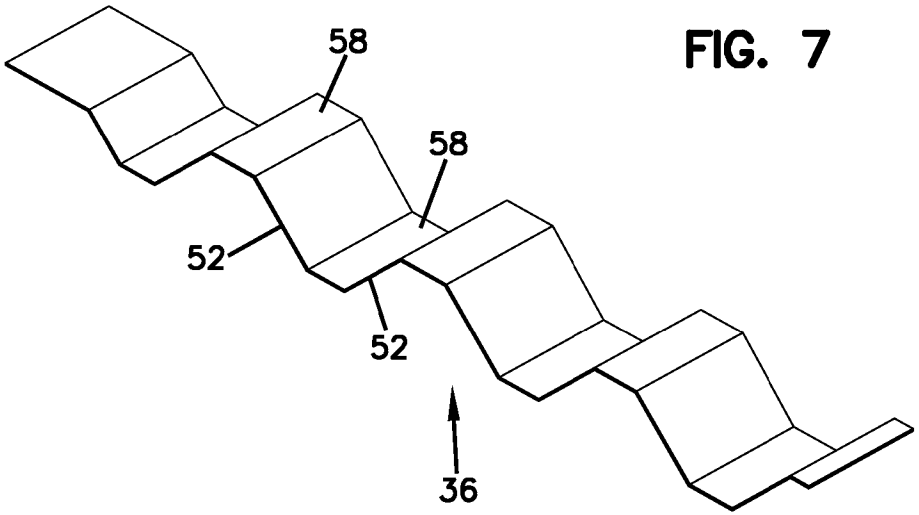
FIG. 7 is a perspective view of the divider of the steam dispersion system of FIG. 1.
Figure 8:
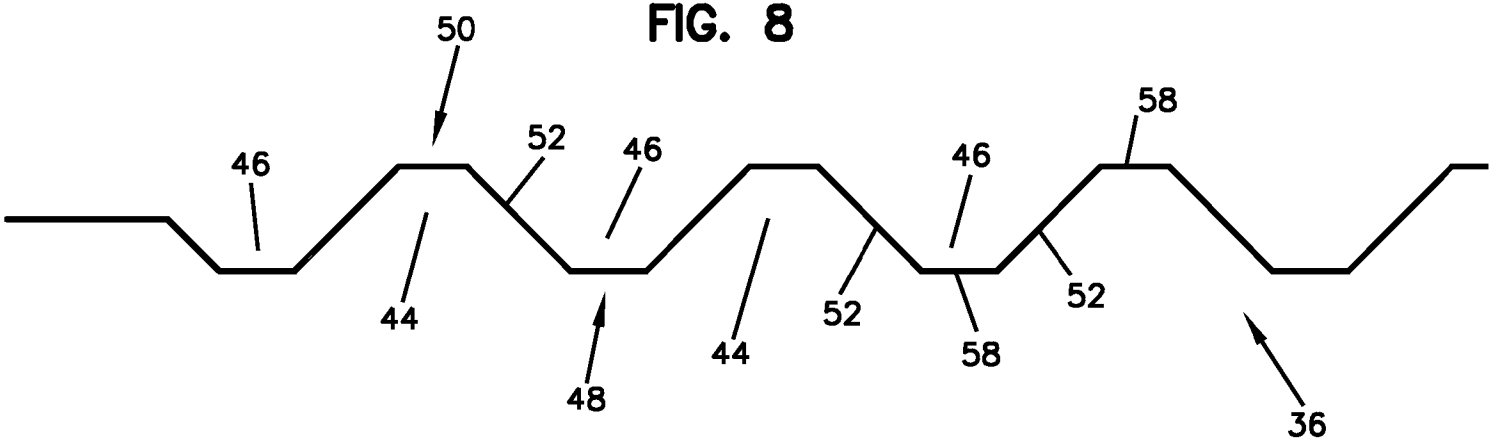
FIG. 8 is a top view of the divider of FIG. 7.

The divider 36 is shown in closer detail in FIGS. 7 and 8. In the embodiment depicted in FIGS. 7 and 8, the divider 36 is formed from a piece of sheet metal that is bent to define zigzag walls 52 with straight longitudinally extending transition sections 58. The divider 36 defines alternating passages 44, 46 on the front and rear sides 48, 50, respectively, of the divider 36. Each passage 44, 46 is defined by the zigzag walls 52 connected together by the straight sections 58.

The steam dispersion tubes 12 are arranged relative to the header 16 such that half the tubes 12*a* communicate only with the front passages 44 defined by the divider 36 while half the tubes 12*b* communicate only with the rear passages 46 defined by the divider 36. The shape of the divider 36 allows the tubes 12*a*, 12*b* to align along a length $L_H$ of the header 16 and still communicate only with their respective chambers 32, 34. The steam dispersion tubes 12 have lower ends that seat on the top wall 18 (formed by a plate) of the header 16 and above passages 44, 46 with center openings of the tubes 12 in fluid communication with passages 44, 46, wherein each tube 12 aligns with a corresponding opening in top wall 18 of header (please see FIG. 2).

Since each chamber 32, 34 in the header 16 includes a separate steam inlet 31, 33, respectively, the amount of the steam flowing into the first and second chambers 32, 34 can be independently controlled. For example, half the steam dispersion tubes 12*b*, e.g., the tubes communicating with the second chamber 34, may be selectively turned off, while the tubes 12*a* communicating with the first chamber 32 remain active. The tubes 12 may be selectively or automatically turned on and off via a control system 14 of the steam dispersion system 10, as will be discussed in further detail below.

Figure 9:
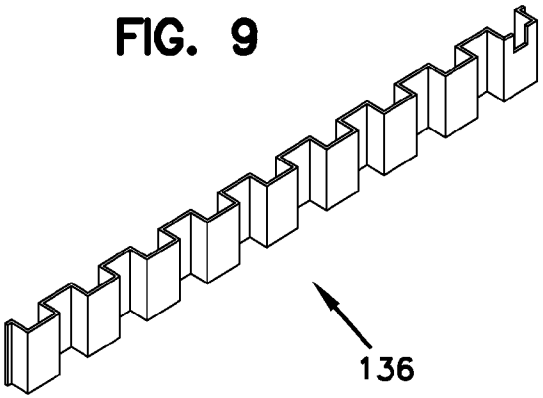
FIG. 9 is a perspective view of an alternative embodiment of a divider configured for use with the steam dispersion system of FIG. 1.
Figure 10:
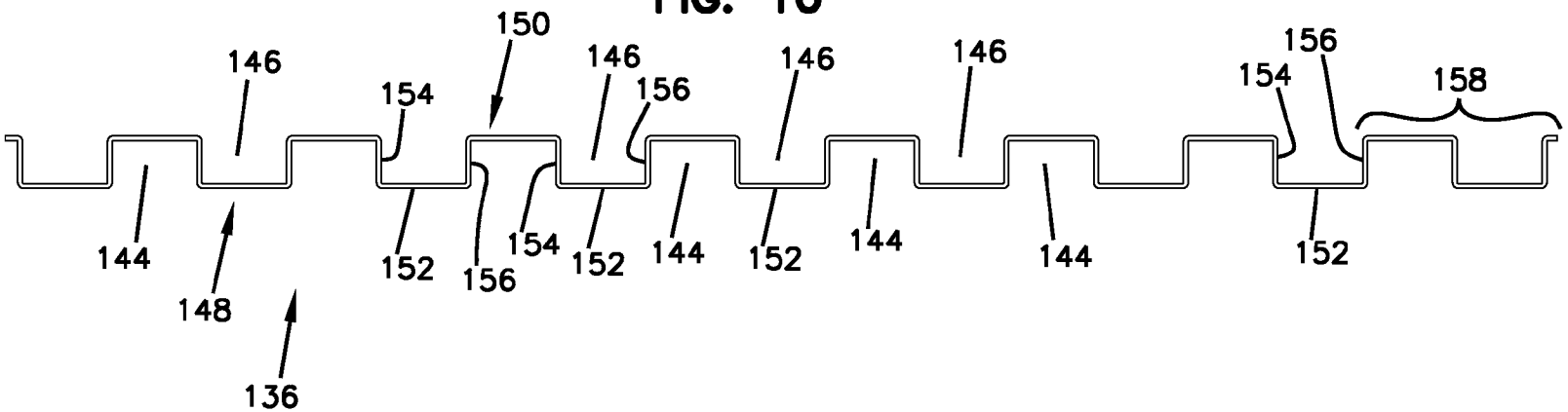
FIG. 10 is a top view of the divider of FIG. 9.

Referring now to FIGS. 9 and 10, an alternative embodiment of a divider 136 that is configured for use with the steam dispersion system 10 is illustrated. In the embodiment depicted in FIGS. 9 and 10, the divider 136 is formed from a piece of sheet metal that is bent to define alternating passages 144, 146 on the front and rear sides 148, 150 of the divider 136. Each passage 144, 146 is defined by a longitudinal wall 152 extending between a first transverse wall 154 and a second transverse wall 156. The longitudinal walls 152 and the transverse walls 154, 156 are generally at 90 degree angles to form S-shaped sections 158 of the divider 136.

Figure 11:
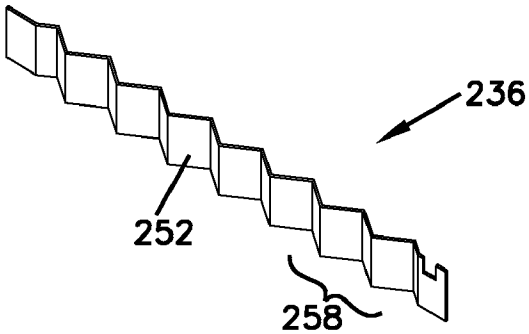
FIG. 11 is a perspective view of another alternative embodiment of a divider configured for use with the steam dispersion system of FIG. 1.
Figure 12:
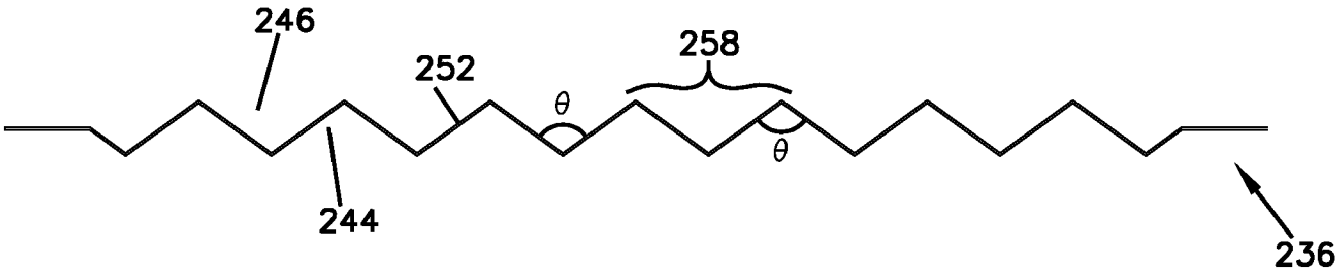
FIG. 12 is a top view of the divider of FIG. 11.

Referring to FIGS. 11 and 12, another alternative embodiment of a divider 236 configured for use with the steam dispersion system is illustrated. The divider 236 is similar to the divider 136 illustrated in FIGS. 9 and 10, except that the divider 236 includes walls 252 that are at obtuse angles θ to each other, defining a zigzag pattern 258. In certain embodiments, the obtuse angles θ may be about 110 degrees. The walls 252 form alternating front and rear passages 244, 246. The same tube arrangement can be used with the divider 236 as with the dividers 36 and 136.

Figure 13:
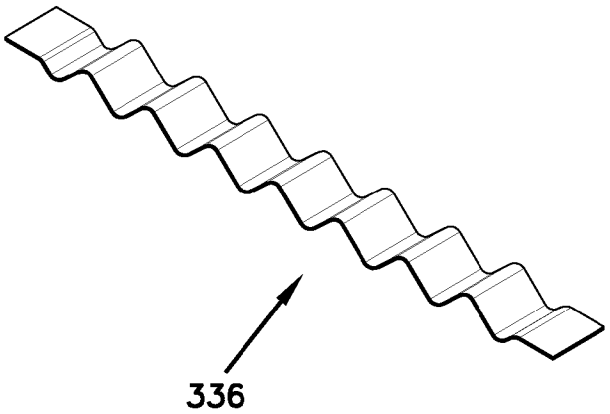
FIG. 13 is a perspective view of yet another alternative embodiment of a divider configured for use with the steam dispersion system of FIG. 1.
Figure 14:
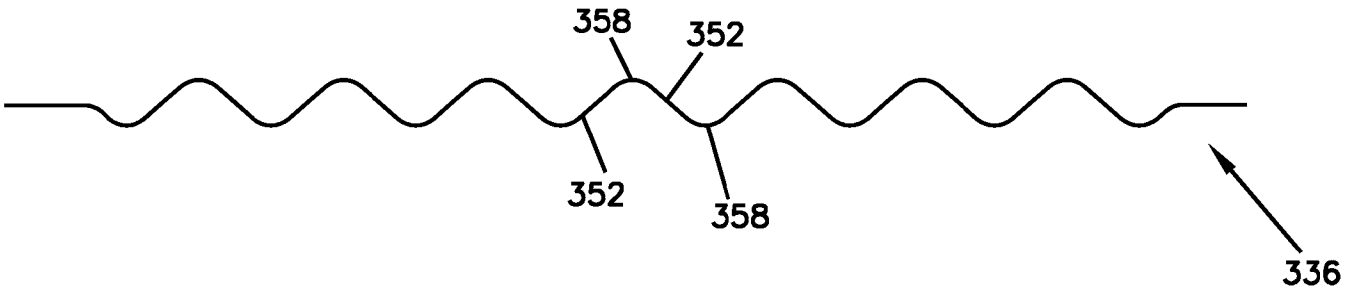
FIG. 14 is a top view of the divider of FIG. 13.

Referring now to FIGS. 13 and 14, yet another alternative embodiment of a divider 336 is illustrated. The divider 336 is similar to the divider 236 illustrated in FIGS. 11 and 12, except that the divider 336 includes smooth, curved transitions 358 between the walls 352. In certain embodiments, the walls 352 may be bent at about 98 degrees to each other.

Figure 15:
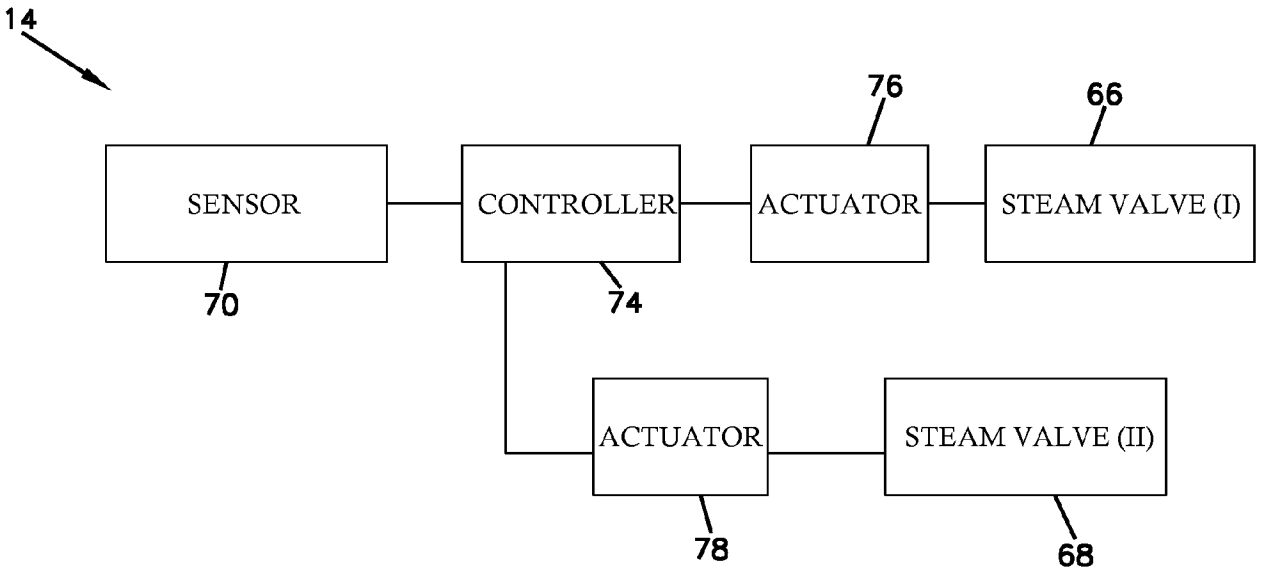
FIG. 15 is a diagram illustrating a control system configured for use with the steam dispersion system of FIG. 1.

Referring now to FIG. 15, an example control system 14 that may be used with the steam dispersion system 10 is diagrammatically illustrated. The steam dispersion system 10 may include a first valve 66 that is used to control the amount of steam supplied to the first chamber 32 through inlet 31 and a second valve 68 that is used to control the amount of the steam supplied to the second chamber 34 through inlet 33. The first and second valves 66, 68 may be turned on or off selectively or automatically.

The first and second valves 66, 68 are preferably steam valves that modulate the steam flow rate into the steam dispersion system header 16 based on the difference between a desired humidity value and a measured humidity value. For example, in certain embodiments, the desired humidity value may be a desired relative humidity (RH) and the measured humidity value may be an actual, measured RH in a given environment.

A modulating valve, as used herein, refers to a valve that proportionately controls the steam flow rate according to humidification needs. Since configurations and operations of modulating valves are known in the art, further details thereof will not be provided herein, it being understood that those skilled in the art clearly understand the nature of such valves and how they operate in numerous environments.

It should also be noted that the first and second valves 66, 68 do not necessarily have to be modulating valves and could be any type of a valve that controls the amount of steam flow. The first and second valves 66, 68 may be valves that operate only between an "on" and an "off" position or they may be valves that operate at positions in between a completely "on" and a completely "off" position.

The modulation of the first and second valves 66, 68 may occur automatically via the use of a humidity sensor 70 (such as a humidistat, a humidity transmitter, a dew point sensor, etc.), a controller 74, and steam valve actuators 76, 78 for each of the respective valves, 66, 68. In other embodiments, the steam dispersion system 10 may operate based on conditions other than humidity values, and, thus, other types of sensors 70, such as a thermostat, may be utilized.

When the humidification load is below a predetermined threshold point, the first valve 66 may automatically modulate the steam flow to the first chamber 32. The inactive tubes 12*b*, those not having steam flowing therethrough, remain inactive and at the duct air temperature, until the predetermined load point is reached.

In a preferred embodiment, when the humidification load is half or less of the design condition load (i.e., when the difference between a desired relative humidity (RH) value and an actual, measured RH value in a given environment is less than a threshold point), the first valve 66 automatically modulates the steam flow to the first chamber 32, to half of the dispersion tubes 12*a*, based on the difference between a desired RH and the measured RH, as discussed above. The inactive tubes 12*b*, those not having steam flowing therethrough, remain at the duct air temperature. The inactive tubes 12*b* do not create condensate or heat the duct air since they are at the duct temperature. Thus, condensate and heat gain can be nearly cut in half when the second steam valve 68 is closed.

The threshold point to activate the second set if tubes 12*b* may be any predetermined point according to the needs of the system. In certain examples, the threshold point may be defined as a relative humidity demand value that can be met by the maximum capacity of the first valve 66. If the relative humidity demand value (difference between the actual measured humidity value and the predetermined desired humidity value) is great enough such that it cannot be met by the maximum capacity of the first valve 66, then the threshold point of the first valve 66 has been met and the second valve 68 needs to open to meet the demand. As noted above, in certain embodiments, the threshold point may be half of the design condition load.

When the first steam valve 66 is wide open and at its maximum steam flow rate, any additional humidification demand requirements (i.e., increasing the difference between the actual relative humidity value and the predetermined desired relative humidity value to the threshold point) activates the second steam valve 68. Thus, when this demand is reached, the first valve 66 stays wide open while the second steam valve 68 automatically begins to modulate the steam flow rate to the previously inactive tubes 12*b*, maintaining the desired RH. The steam valve flow rates will be controlled by the control system 14 such that the sum of the flow rates of the first and second valves 66, 68 will be approximately equal to the design condition load.

As RH demand decreases below about half the design condition load (i.e., when the difference between the desired relative humidity (RH) value and the actual, measured RH value in a given environment goes below the threshold point), the second steam valve 68 completely closes, and the first steam valve 66 resumes modulation.

The first and the second valves 66, 68 may, thus, be used to both modulate the steam flow for controlling the RH and to completely turn on and off dispersion tubes 12 as needed. As discussed above, in other embodiments, other types of valves, e.g., non-modulating valves that automatically only turn on or off tubes can be used.

Figure 16:
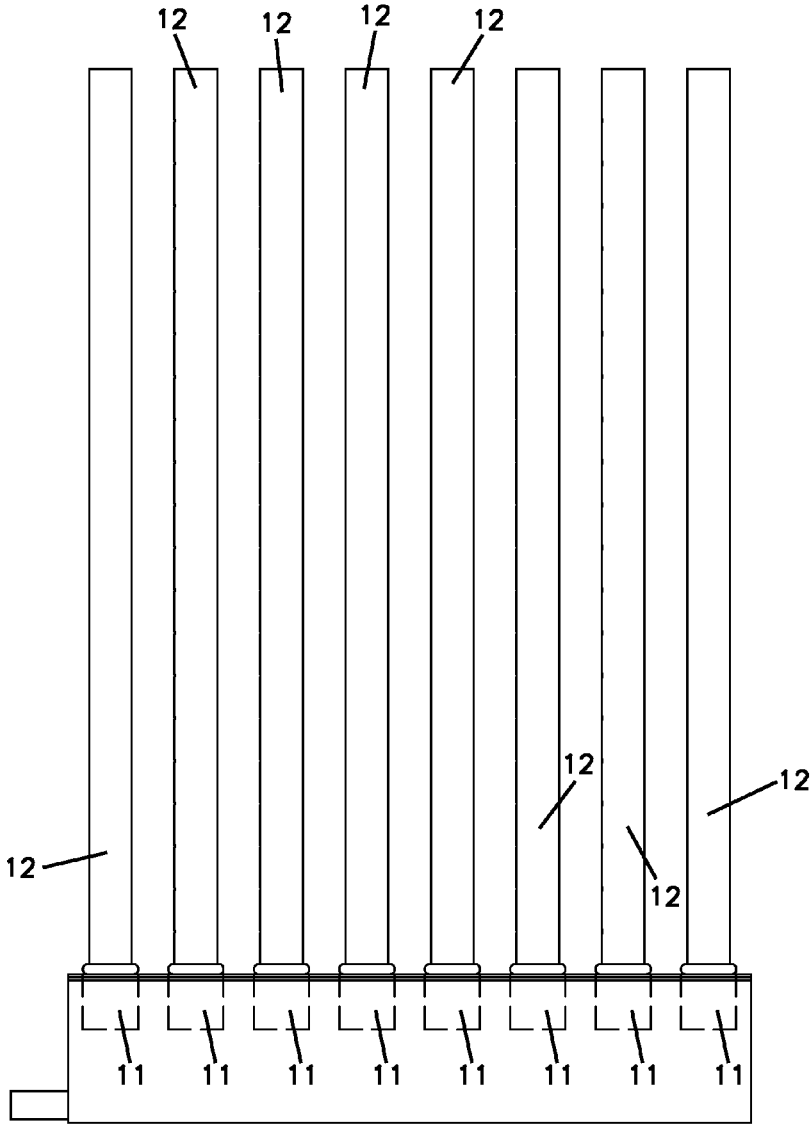
FIG. 16 is a schematic view of an alternative embodiment of a steam dispersion system having features that are examples of inventive aspects in accordance with the principles of the present disclosure, wherein each steam dispersion tube includes its own valve for turning on/off the tubes independently.
Figure 17:
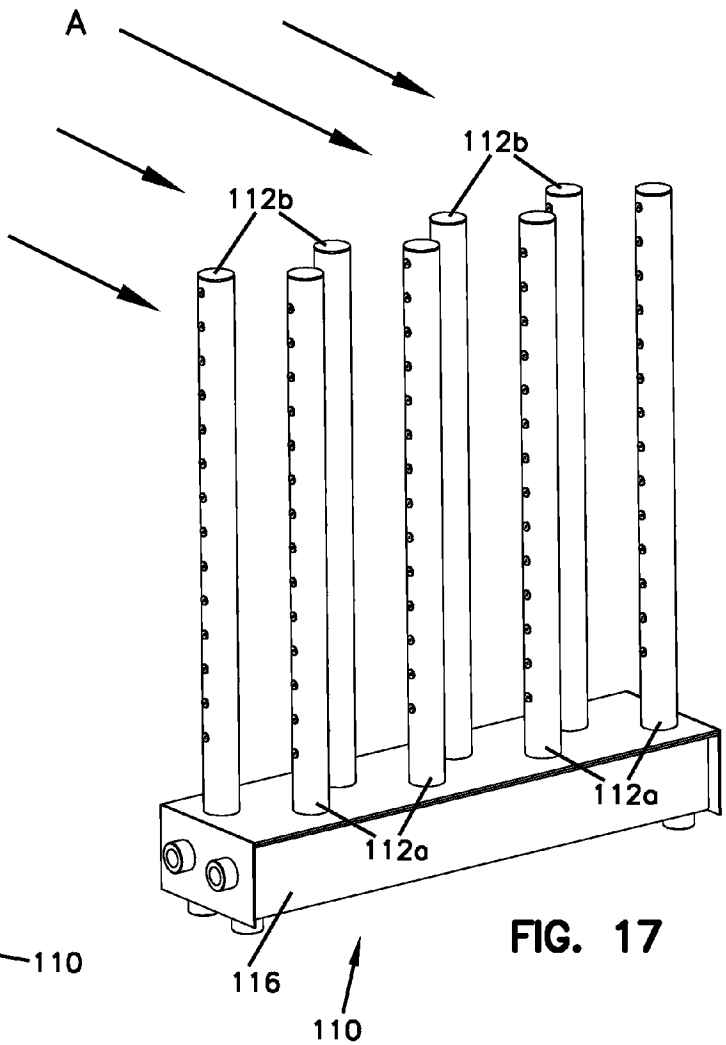
FIG. 17 is a perspective view of another alternative embodiment of a steam dispersion system having features that are examples of inventive aspects in accordance with the principles of the present disclosure.
Figure 20:
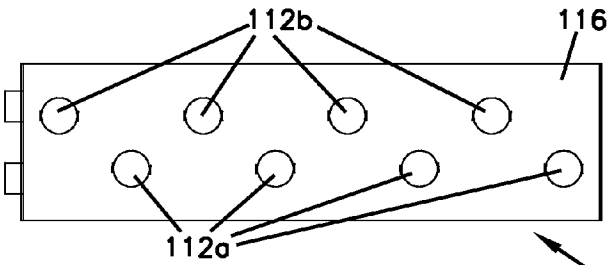
FIG. 20 is a top view of the steam dispersion system of FIG. 17.
Figure 19:
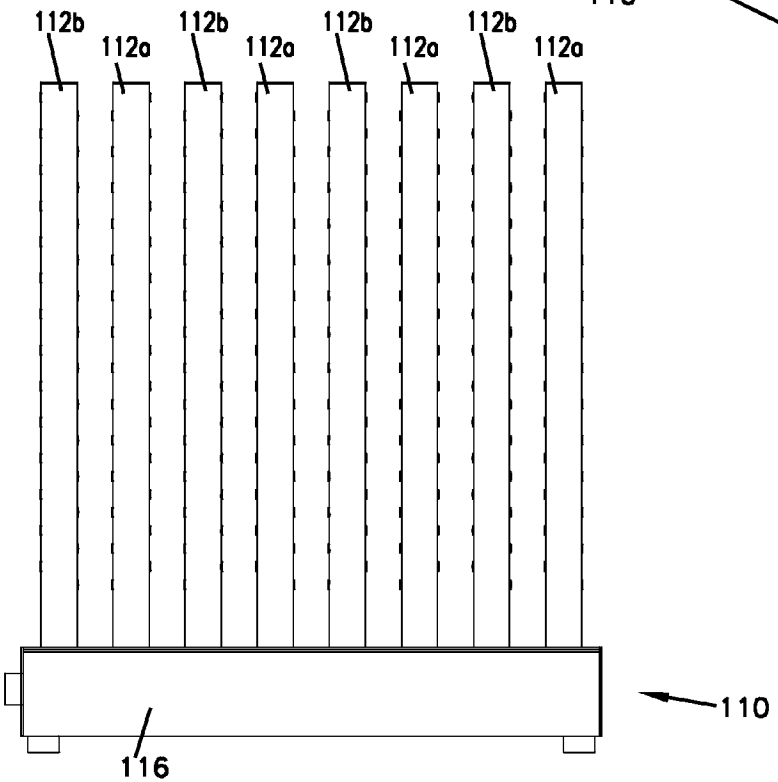
FIG. 19 a front view of the steam dispersion system of FIG. 17.
Figure 18:
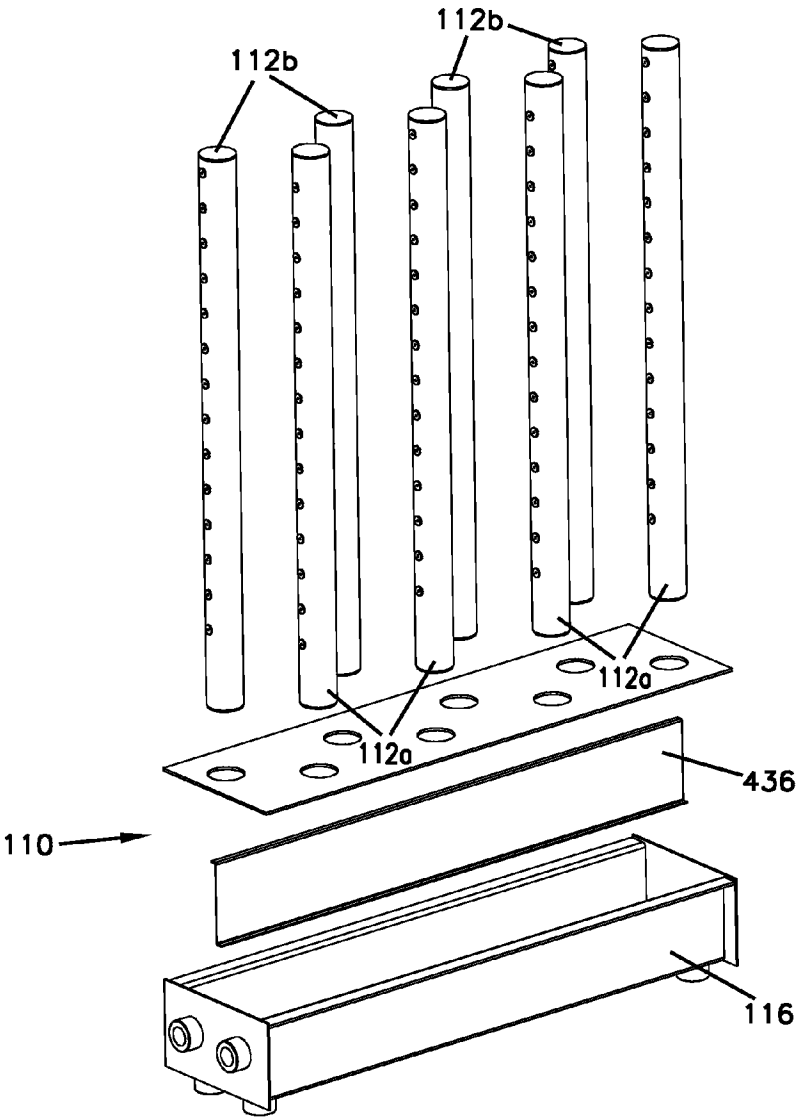
FIG. 18 is an exploded perspective view of the steam dispersion system of FIG. 17.
Figure 22:
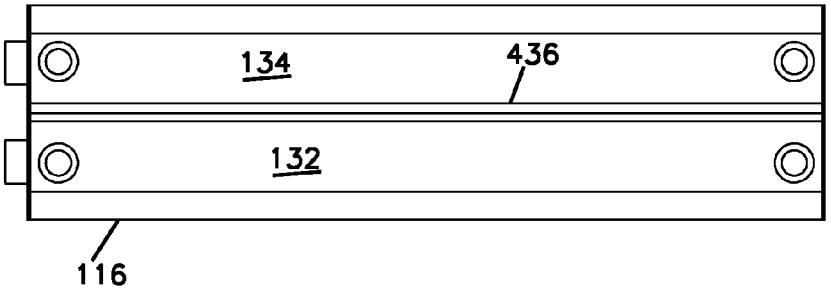
FIG. 22 is a top view of the header and the divider of FIG. 21.
Figure 21:
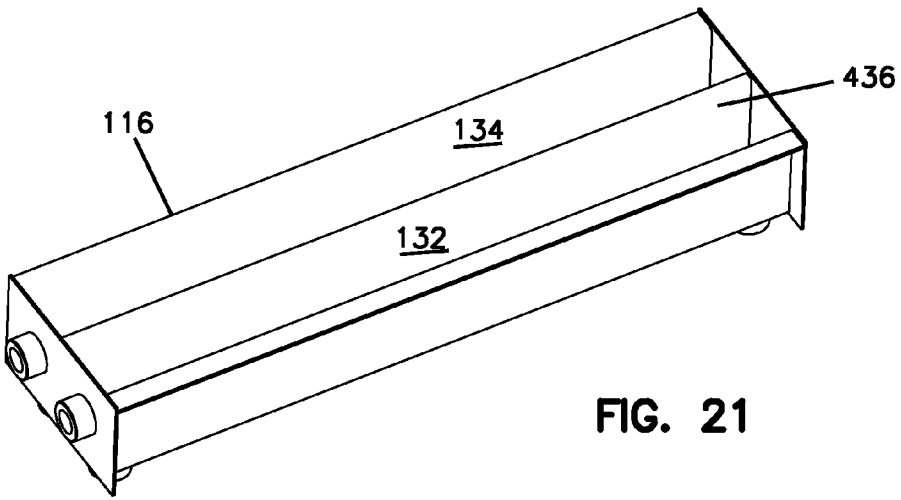
FIG. 21 is a perspective view showing a header and a divider within the header of the steam dispersion system of FIG. 17.

In certain other embodiments, instead of a header divided into two separate valve-regulated chambers, the steam dispersion system may include an on/off valve 11 on each of the tubes 12 or on some of the tubes 12 (please see schematic at FIG. 16). In such an embodiment, the steam flow rate can be modulated with a main valve that controls steam flow to the entire header 12 and each tube 12 can be turned on/off via their associated valves 11 based on the sensed load to maintain the desired RH. For example, if there are ten dispersion tubes 12, each with its own valve 11, when 10% of the design condition is desired, only one tube 12 would be active. In such an embodiment, when 20% of the design condition is desired, two tubes 12 would be active, and so forth. When the design condition is desired, all ten tubes 12 would be active to meet the 100% demand.

Referring now to FIGS. 17-20, an alternative embodiment of a steam dispersion system 110 is illustrated. The steam dispersion system 110 is similar in configuration and operation to steam dispersion system of FIGS. 1-4, except that the steam dispersion system 110 includes a zigzag steam dispersion tube arrangement and a straight divider 436 dividing the header 116 into first and second chambers 132, 134, unlike the straight tube configuration of the steam dispersion system 10 of FIGS. 1-4. The front tubes 112*a* communicate with the first chamber 132 and the offset rear tubes 112*b* communicate with the second chamber 134.

In operating the embodiment of the steam dispersion system 110 illustrated in FIGS. 17-20, the front tubes 112*a* (i.e., downstream tubes relative to the direction of the airflow A) are preferably turned on first. In this manner, when the second set of tubes, the rear tubes 112*b*, are turned on in response to increased humidity demand, the front tubes 112*a* will already be hot and not condensate out.

It should be noted that, in other embodiments of a steam dispersion system, a single header including separate interior chambers do not have to be used. In other embodiments, the steam dispersion system may include physically separated headers that form physically separate interior chambers, wherein the headers are controlled by and form part of a single steam dispersion system. In such an embodiment, the valves for regulating the steam flow into each of the separate headers may still be controlled by a single control system, operatively connected to a sensor for turning the separate valves on and off to meet the desired humidity demand.

In yet another embodiment of the steam dispersion system, the steam dispersion system may be operated without adding or subtracting steam dispersion tubes as needed in response to the humidification demand. In such an embodiment, the steam dispersion system can be operated by replacing active tubes with another set of differently configured tubes. In such an embodiment, for example, two sets of steam dispersion tubes (each communicating with a separate interior chamber), wherein each set can meet a different demand amount, can be used. For example, each set may include different sized tubes or a different number of tubes than the other set. In such a system, a first plurality of steam dispersion tubes (e.g., smaller sized or smaller number of steam dispersion tubes) communicating with a first chamber may be in the "on" position while a second plurality of steam dispersion tubes (e.g., larger-sized or larger number of steam dispersion tubes) communicating with a second chamber are in the "off" position. When the threshold point is reached, the first plurality of steam dispersion tubes may be completely turned off while the second plurality of steam dispersion tubes are turned on to meet the desired humidification load.

Figure 23:
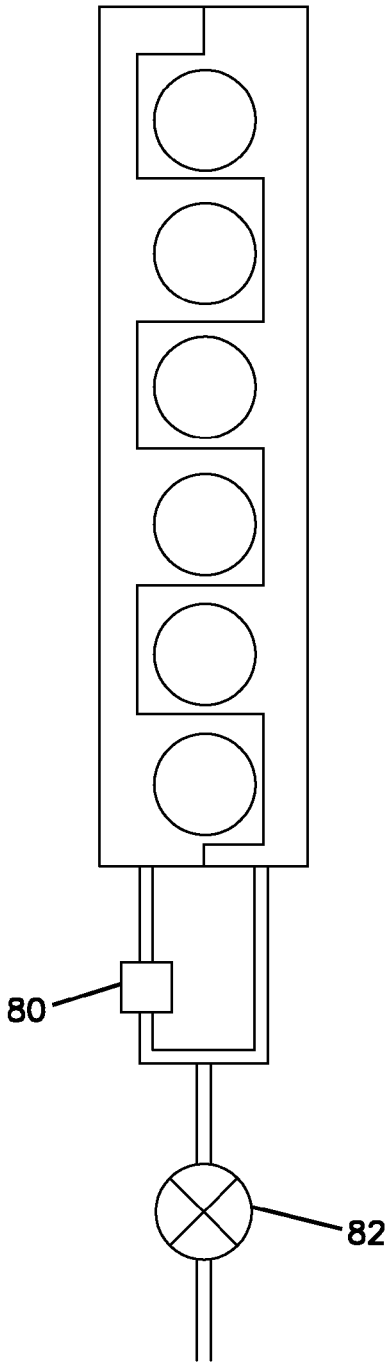
FIG. 23 is a schematic diagram of an alternative valve arrangement for use with the steam dispersion systems illustrated in FIGS. 1 and 17.

In yet another embodiment of a steam dispersion system, wherein the system includes two chambers, a single valve (e.g., a modulating valve) can be used in combination with a two-position device (e.g., solenoid, gate, damper, etc.) to control steam flow into each of the chambers. In such an embodiment, as illustrated schematically in FIG. 23, the steamflow may be branched-off into two lines after passing through the single valve 82, wherein each line feeds steam into each of the separate chambers of the steam dispersion system. As illustrated, one of the lines includes the two-position device 80. The two-position device 80 is configured to block steamflow into its associated chamber until the threshold point is reached. When the threshold point is reached, the two-position device 80 would open and join the valve 82 in allowing steam to flow into both of the chambers of the steam dispersion device to meet the desired demand. Such a system can also be operated in reverse as discussed for the previous embodiments. As discussed above, in such a configuration, if the two chambers include equal sized and number of tubes, the threshold point would be 50% of the design condition load.

Although in the foregoing description of the steam dispersion systems 10, 110, terms such as "top", "bottom", "front", "back", "right", and "left" may have been used for ease of description and illustration, no restriction is intended by such use of the terms. The steam dispersion systems 10, 110 described herein can be used in any orientation within a duct.

The above specification, examples and data provide a complete description of the manufacture and use of the composition of the inventive features of the disclosure. Since many embodiments of the inventive aspects of the disclosure can be made without departing from the spirit and scope of the disclosure, the inventive aspects reside in the claims hereinafter appended.

We claim:

1. A steam dispersion system comprising:

a header;

a divider dividing the header into first and second interior chambers, the first and second interior chambers generally not being in fluid communication with each other, the header including a first inlet for inletting steam into the first chamber and a second inlet for inletting steam into the second chamber;

a first plurality of steam dispersion tubes and a second plurality of steam dispersion tubes extending from the header, the first plurality of steam dispersion tubes communicating only with the first interior chamber, the second plurality of steam dispersion tubes communicating only with the second interior chamber;

a control system including a sensor for measuring a measured humidity value, a first valve regulating steam flow into the first chamber through the first inlet, and a second valve regulating steam flow into the second chamber through the second inlet, the first and second valves regulating steam flow based on a difference between the measured humidity value and a predetermined desired humidity value, the first and second valves operable between an open position and a closed position, wherein, when the difference between the measured humidity value and the desired humidity value is below a threshold point, only the first valve is in the open position, and, wherein, when the difference between the measured humidity value and the predetermined desired humidity value increases to the threshold point, the second valve also operably moves to an open position.

2. A steam dispersion system according to claim 1, wherein the first and second valves are modulating valves, wherein the first and second valves modulate when in an open position.

3. A steam dispersion system according to claim 1, wherein the sensor is a humidistat.

4. A steam dispersion system according to claim 1, wherein after the second valve has moved to an open position, if the difference between the measured humidity value and the desired humidity value decreases past the threshold point, the second valve operably moves to a closed position, with only the first valve remaining in the open position.

5. A steam dispersion system according to claim 1, wherein the header includes generally planar walls defining substantially right angles thereinbetween.

6. A steam dispersion system according to claim 1, wherein the first plurality of steam dispersion tubes and the second plurality of steam dispersion tubes are aligned in a row along a length of the header.

7. A steam dispersion system according to claim 6, wherein the divider includes S-shaped sections.

8. A steam dispersion system according to claim 6, wherein the divider includes a zigzag shape.

9. A steam dispersion system according to claim 1, wherein the first plurality of tubes are offset front to back relative to the second plurality of tubes, wherein the divider is planar.

10. A method of dispersing steam comprising the steps of:

(a) providing a header with first and second interior chambers, the first and second interior chambers generally not being in fluid communication with each other, the header including a first inlet for inletting steam into the first chamber and a second inlet for inletting steam into the second chamber;

(b) providing a first plurality of steam dispersion tubes and a second plurality of steam dispersion tubes extending from the header, the first plurality of steam dispersion tubes communicating only with the first interior chamber, the second plurality of steam dispersion tubes communicating only with the second interior chamber;

(c) providing a first valve for regulating steam flow into the first chamber through the first inlet and a second valve for regulating steam flow into the second chamber through the second inlet;

(d) opening the first valve; and (e) opening the second valve in addition to the first valve when the difference between a measured humidity value and a predetermined desired humidity value increases to a threshold point.

11. A method according to claim 10, further comprising the step of closing the second valve when the difference between the measured humidity value and the predetermined desired humidity value decreases past the threshold point.

12. A method according to claim 11, wherein the first and second valves are opened and closed automatically by a control system including a humidistat.

13. A method according to claim 11, when the first and second valves modulate at the open position.

14. A steam dispersion system comprising:

a first interior chamber with a first steam dispersion tube in fluid communication with the first interior chamber;

a second interior chamber with a second steam dispersion tube in fluid communication with the second interior chamber, the second interior chamber not being in fluid communication with the first interior chamber;

the first interior chamber including a first valve for controlling the amount of steam flow into the first interior chamber;

the second interior chamber including a second valve for controlling the amount of steam flow into the second interior chamber, wherein the first valve can be turned on or off independently of the second valve;

wherein the first valve and the second valve automatically operate together as part of a single steam dispersion control system to control the amount of steam entering each of the first and second interior chambers.

15. A steam dispersion system according to claim 14, further comprising a plurality of steam dispersion tubes communicating with each of the first and second interior chambers.

16. A steam dispersion system according to claim 14, wherein the first and the second interior chambers are located within a single header and separated by a divider.

17. A steam dispersion system according to claim 16, wherein the divider includes a generally S shape.

* * * * *

UNITED STATES PATENT AND TRADEMARK OFFICE

CERTIFICATE OF CORRECTION

PATENT NO. : 7,980,535 B2
APPLICATION NO. : 11/804991
DATED : July 19, 2011
INVENTOR(S) : Dovich et al.

It is certified that error appears in the above-identified patent and that said Letters Patent is hereby corrected as shown below:

Col. 9, line 13, claim 13: "when the first and" should read --wherein the first and--

Signed and Sealed this
Twenty-eighth Day of February, 2012

David J. Kappos

David J. Kappos
*Director of the United States Patent and Trademark Office*